US012378757B2

(12) United States Patent
Pitruzzello et al.

(10) Patent No.: US 12,378,757 B2
(45) Date of Patent: Aug. 5, 2025

(54) SYSTEMS, APPARATUS, AND METHODS FOR ISOLATING FLOW IN A STORMWATER MANAGEMENT CRATE ARRAY

(71) Applicant: Advanced Drainage Systems, Inc., Hilliard, OH (US)

(72) Inventors: Cal Pitruzzello, Middlefield, CT (US); Paul Holbrook, Old Saybrook, CT (US); Adam Miller, Haddam, CT (US); Bryan Coppes, Old Saybrook, CT (US); Samuel Lee, Spring, TX (US)

(73) Assignee: ADVANCED DRAINAGE SYSTEMS, INC., Hilliard, OH (US)

( * ) Notice: Subject to any disclaimer, the term of this patent is extended or adjusted under 35 U.S.C. 154(b) by 268 days.

(21) Appl. No.: 18/162,505

(22) Filed: Jan. 31, 2023

(65) Prior Publication Data

US 2024/0254751 A1 Aug. 1, 2024

(51) Int. Cl.
*E03F 1/00* (2006.01)
*E03F 5/14* (2006.01)

(52) U.S. Cl.
CPC ..... *E03F 1/005* (2013.01); *E03F 5/14* (2013.01)

(58) Field of Classification Search
CPC ..... E03F 1/003; E03F 1/005; E03F 5/14
See application file for complete search history.

(56) References Cited

U.S. PATENT DOCUMENTS 4,145,157 A * 3/1979 Lascelles ..... E02B 13/00 405/48
5,895,579 A * 4/1999 Schloss ..... E02B 8/04 210/162
6,460,574 B2 * 10/2002 Currie ..... E03F 5/101 138/116

(Continued)

FOREIGN PATENT DOCUMENTS

DE 29924050 U1 10/2001
EP 1820914 A1 8/2007
EP 2687642 A1 1/2014

OTHER PUBLICATIONS

International Search Report and Written Opinion from PCT/US2024/013540, May 15, 2024; 20 pages.

(Continued)

*Primary Examiner* — Benjamin F Fiorello
(74) *Attorney, Agent, or Firm* — Finnegan, Henderson, Farabow, Garrett & Dunner LLP

(57) ABSTRACT

Weir systems, methods, and apparatuses for containing and filtering runoff may be provided. In one implementation, a modular weir may be used to isolate suspended solids from a flow of water in a stormwater management crate array. The modular weir may include a plurality of weirs configured to isolate the flow of water from the stormwater management crate, a plurality of column grooves along the one or more weirs configured to extend around a plurality of columns in the stormwater management crate, an inlet located at a first end of the plurality of weirs configured to receive the flow of water within the stormwater management crate, and a cap (Continued)

located at a second end of the plurality of weirs configured to contain the flow of water within the modular weir.

18 Claims, 12 Drawing Sheets

(56) References Cited

U.S. PATENT DOCUMENTS

| | | | | |
|---|---|---|---|---|
| 6,648,549 | B1 * | 11/2003 | Urriola | E02B 11/005 210/170.03 |
| 11,028,569 | B2 | 6/2021 | Spires et al. | |
| 2001/0042568 | A1 | 11/2001 | Darling | |
| 2006/0242915 | A1 * | 11/2006 | Frost | E02D 19/00 52/302.1 |
| 2010/0021236 | A1 * | 1/2010 | Kreikemeier | E03F 1/005 405/55 |
| 2010/0296871 | A1 * | 11/2010 | Heitker | E03F 1/005 405/43 |
| 2013/0115003 | A1 * | 5/2013 | Burkhart, Sr. | E03F 5/101 405/80 |
| 2016/0097175 | A1 * | 4/2016 | Parker | E03F 1/005 405/184.4 |
| 2021/0147254 | A1 * | 5/2021 | Figola | C02F 1/004 |

OTHER PUBLICATIONS

Stormtank, "Module 25 Series Design Guide," https://stormwater.brentwoodindustries.com/wp-content/uploads/sites/3/2020/07/Module-25-Series-Design-Guide.pdf.

ACF Environmental, "R Tank Stormwater Detention System," Sep. 2018, https://acfenvironmental.com/wp-content/uploads/2015/09/Broc-RTank-Sept-2018.pdf.

Stormtank, "Module 25 Series Design Guide," Mar. 7, 2020, https://stormwater.brentwoodindustries.com/wp-content/uploads/sites/3/2020/07/Module-25-Series-Design-Guide.pdf.

* cited by examiner

SYSTEMS, APPARATUS, AND METHODS FOR ISOLATING FLOW IN A STORMWATER MANAGEMENT CRATE ARRAY

TECHNICAL FIELD

This disclosure relates generally to systems, apparatus, and methods for fluid run-off management systems. In particular this disclosure relates to enhancing efficiency and efficacy of fluid runoff maintenance systems through the use of modular weirs in stormwater management crates.

BACKGROUND

Fluid runoff systems include systems designed to process rainwater or other fluid runoff, particularly stormwater. These systems can be used to control water in areas that may experience overloads in the local drainage system during periods of high precipitation, such as around construction sites and developed urban areas. These systems temporarily store and divert water runoff from impervious surfaces, such as sidewalks, roads, and parking lots. The system then controls the fluid discharge back to the environment to meter rainfall discharge from a site and reduce the risk of flooding. Stormwater also carries debris and solid contaminants, such as dirt, sand, and organic debris. Fluid management systems are designed to receive and retain stormwater, allowing particulates to settle at the bottom of the chamber before the stormwater is released out of the system. Fluid management systems may include above-ground storage systems such as ponds, swales, or holding tanks. Fluid management systems may also include below-ground systems such as underground storage chambers, concrete drainage structures, thermoplastic storage chambers, or crate-type water management systems.

Crate-type water management systems may be used to form a chamber suitable for managing stormwater runoff. For example, multiple stormwater management crates may be connected together into a modular array of stormwater management crates, forming a stormwater management crate array. Stormwater management crate arrays may be placed underground, typically underneath parking lots or green spaces. These assemblies may be wrapped in a membrane to prohibit infiltration of surrounding soil or other aggregates into the stormwater management crate array, forming a void space within the assembly for the storage of stormwater runoff. These underground assemblies accommodate a site's water volume runoff and treatment requirements and also maximize the site's buildable area for other beneficial uses.

During a storm, stormwater or rainwater runoff enters the underground stormwater management crate array, and in some configurations, may exit the assembly by flowing through a conduit connecting the assembly to another system component, such as a basin or another drainage structure. The stormwater management crate array may be placed on a prepared bed of coarse aggregate or stone, and may be backfilled underground with aggregate, earth, or other suitable backfill material.

Stormwater carries debris and solid contaminants that can pass into and through basins, traps, and filters of conventional stormwater management systems. Stormwater may include suspended solids, including dirt, sand, organic debris such as leaves, paper, and plastic. Crate-type water management systems may be configured to receive stormwater and allow debris to settle to a bottom of the assembly before the stormwater is released into the ground or through an outlet or may be used to restrict the volume or discharge rate of stormwater runoff from leaving the site.

Existing stormwater management systems have been developed that prevent some debris and solid contaminants from reaching the crates. For example, some crate-type stormwater management systems are configured to divert surface stormwater to a solids retention system, and then into the array of chambers so that an amount of debris and solid contaminants that enter the crates connected to the system is minimized. Solids suspended or entrained in the stormwater are retained by the solids retention system using a combination of settling and filtering actions. When stormwater inflow exceeds a capacity of the solids retention system, the water rises in the diverter to an overflow point at which water flows through a bypass line to the crate array.

However, solutions are needed to improve the isolation of debris and solid contaminants in stormwater management crate systems. Such solutions should provide modular weirs configured to fit within the space between internal columns of stormwater management crate units. Other improvements should include containing debris and solid contaminants on all sides to isolate such contaminants from the array of stormwater management crates. Solutions should also include providing a flat bottom surface of the modular weir to allow for easier cleaning of isolated sediment and debris from the bottom of the modular weir. Further solutions should reduce the labor and assembly costs by reducing the weight of the modular weir and allow for easier field assembly and installation of the modular weir within a stormwater management crate array.

SUMMARY

The disclosed embodiments describe systems, methods, and devices for isolating sediment and debris from fluid runoff. These systems, methods, and devices may include a modular weir configured to isolate suspended solids from a flow of water in a stormwater management crate. For example, in an embodiment, a portion of a stormwater management crate array for managing stormwater runoff may include a modular weir. Some embodiments may include one or more weirs configured to isolate the flow of water from the stormwater management crate, a plurality of column grooves along the one or more weirs configured to extend around a plurality of columns in the stormwater management crate, an inlet located at a first end of the one or more weirs configured to receive the flow of water within the stormwater management crate, and a cap located at a second end of the one or more weirs configured to contain the flow of water within the modular weirs.

In some embodiments, the one or more weirs may comprise a flat bottom configured to collect the suspended solids from the flow of water. In other embodiments, the one or more weirs may be thermoformed. In yet other embodiments, the one or more weirs may further comprise one or more body connections configured to connect a first wall and a second wall of the one or more weirs at a top of the one or more weirs. In some embodiments, a first weir may have a first end configured to connect to an end of a second weir and the first weir may have a second end configured to connect to a third weir, permitting a plurality of weirs to be connected in a row in a longitudinal direction. In some embodiments two weirs may be connected end-to-end in this manner, while in other embodiments, three, four, five, and more weirs may be connected end-to-end. In some embodiments, a length of the one or more weirs may be a same length as a length of a stormwater management crate unit.

In some embodiments, each of the one or more weirs may further comprise a tray with a bottom, a first wall, and a second wall, wherein each of the first wall and the second wall extend at an angle from the tray to a top of the plurality of columns in the stormwater management crate. In some embodiments, the first wall and the second wall may comprise a plurality of column grooves configured to wrap around the plurality of columns in the stormwater management crate.

In some embodiments, each of the one or more weirs may further comprise a first tray, a second tray, and first and second connection surfaces connecting the first tray and the second tray. Each of the first tray and the second tray may comprise: a central surface, a first wall, and a second wall, each of the first wall and the second wall extending at an angle from the central surface, the central surface configured to extend between the first wall and the second wall. The first connection surface may be located at an end of the first wall of the first tray and at an end of the second wall of the second tray, the first connection surface being configured to connect the first tray to the second tray. The second connection surface may be located at an end of the second wall of the first tray and at an end of the first wall of the second tray, the second connection surface being configured to connect the first tray to the second tray. In some embodiments, the first wall and the second wall may comprise a plurality of column grooves configured to wrap around the plurality of columns in the stormwater management crate.

In another embodiment, the one or more weirs may further comprise a tube configured to fit between the plurality of columns in the stormwater management crate. In some embodiments, the tube may be a blow molded tube, a twin sheet thermoformed tube, or an extruded tube.

In another embodiment, an array of modular weirs may be configured to isolate suspended solids from a flow of water in a stormwater management box. Such an array of modular weirs may comprise: one or more weirs configured to isolate the flow of water from the stormwater management box; a column extension extending at a right angle from the one or more weirs, wherein the column extension is configured to extend between a plurality of columns in the stormwater management box; an inlet located at a first end of the one or more weirs configured to receive the flow of water within the stormwater management box; and a cap located at a second end of the one or more weirs configured to contain the flow of water within the array of modular weirs.

In some embodiments, each of the one or more weirs may comprise a flat bottom configured to collect suspended solids from the flow of water. In other embodiments, each of the one or more weirs may comprise a curved bottom configured to collect suspended solids from the flow of water. In yet other embodiments, an array of weirs may include one or more weirs having a flat bottom and one or more weirs having a curved bottom. In other embodiments, the one or more weirs may be thermoformed. In yet other embodiments, a weir may further comprise a plurality of body connections configured to connect a first wall and a second wall of the weir at a top of the weir. In other embodiments, a first weir included in an array of weirs may be configured to connect to a second weir in the array of weirs. In some embodiments, the first weir may have a male connector at a first end of the first weir, the male connector being configured to mate with a female connector located on a second end of the second weir in an array of weirs. In such an embodiment, the first weir and second weir are connected in an end-to-end fashion. The second weir may have a male connector located at a first end of the second weir, the male connector being configured to mate with a female connector of a third weir. In such an embodiment, the first weir, second weir, and third weir may be connected in a row in an end-to-end manner. In some embodiments, more than three weirs may be connected in a row in a similar end-to-end manner.

In another embodiment, a flat sheet weir may be configured to isolate suspended solids from a flow of water in a stormwater management box. Such a flat sheet weir may comprise: an inlet configured to receive the flow of water within the stormwater management box; a top column panel and a bottom column panel configured to cover a top plate and a base plate of the stormwater management box; a first side panel and a second side panel configured to extend between the top column panel and the bottom column panel outside a plurality of columns in the stormwater management box; and a cap configured to contain the flow of water within the flat sheet weir.

In some embodiments the top column panel and the bottom column panel may further comprise a plurality of openings configured to fit around the plurality of columns in the stormwater management box. In other embodiments, a length and a width of each of the plurality of openings may correspond to a length and a width of each of the plurality of columns in the stormwater management box. In other embodiments, the first side panel and the second side panel may extend between the top plate and the bottom plate within the plurality of columns in the stormwater management box. In such embodiments, a width of the top plate and a width of the bottom plate may correspond to a distance between each of the plurality of columns in the stormwater management box. In other embodiments, a height of the first side panel and a height of the second side panel may correspond to a height of each of the plurality of columns in the stormwater management box. In some embodiments, the flat sheet weir may further comprise a weir connection at a first end and a weir connection at a second end of the flat sheet weir configured to connect the flat sheet weir to one or more additional flat sheet weirs. In some embodiments, the weir connection at the first end may comprise a male connector and the weir connection at the second end may comprise a female connector. In such embodiments, the female connector at the second end of the flat sheet weir may be configured to mate with a male connector at a first end of a second flat sheet weir.

In other embodiments, a weir may be configured to isolate suspended solids from a flow of water in a stormwater management crate. Such a weir may comprise: a first wall and a second wall configured to isolate the flow of water in the stormwater management crate; a bottom configured to collect the suspended solids from the flow of water; one or more body connections configured to connect the first wall and the second wall of the weir at a top of the weir, wherein the top of the weir is opposite the bottom of the weir; and a weir connection at a first end and a weir connection at a second end of the weir.

In some embodiments, the first wall and the second wall may comprise a plurality of column grooves configured to extend around a plurality of columns in the stormwater management crate. In some embodiments, a size and a spacing of the plurality of column grooves may correspond to a size and a spacing of the plurality of columns in the stormwater management system. In some embodiments, the weir may further comprise an inlet located at the first end of the weir to receive the flow of water within the stormwater management crate. In other embodiments, the weir may further comprise a cap located at the second end of the weir configured to contain the flow of water within the weir. In some embodiments, the bottom may be flat. In some embodiments, a height of the weir may correspond to a height of the plurality of columns in the stormwater management crate. In some embodiments, the weir connection at the first end may comprise a male connector and the weir connection at the second end may comprise a female connector. In such embodiments, the female connector at the second end of the weir may be configured to mate with a male connector at a first end of a second weir. In some embodiments, the one or more body connections may comprise a single body connection wherein the single body connection may extend along the entire length of the top of the weir.

In another embodiment, a weir may be configured to isolate suspended solids from a flow of water in a stormwater management box. In such embodiments, the weir may comprise: a first wall and a second wall configured to isolate the flow of water in the stormwater management box; a bottom configured to collect the suspended solids from the flow of water; a column extension extending at a right angle from the weir configured to extend between a plurality of columns in the stormwater management box; one or more body connections configured to connect the first wall and the second wall of the weirs at a top of the weir; and a weir connection at a first end and a weir connection at a second end of the weir.

In some embodiments, the weir may further comprise an inlet located at a first end of the weir configured to receive the flow of water within the stormwater management box. In some embodiments, the weir may further comprise a cap located at a second end of the weir configured to contain the flow of water within the weir. In some embodiments, a width of the column extension may correspond to a distance between the plurality of columns in the stormwater management box. In some embodiments, the bottom may be flat. In some embodiments, a height of the weir may correspond to a height of the plurality of columns in the stormwater management box. In some embodiments, the weir connection at the first end may comprise a male connector and the weir connection at the second end may comprise a female connector. In such embodiments, the female connector at the second end of the weir may be configured to mate with a male connector at a first end of a second weir. In some embodiments, the one or more body connections may comprise a single body connection wherein the single body connection may extend along the entire length of the top of the weir.

Additional features and advantages of the disclosed embodiments will be set forth in part in the description that follows, and in part will be obvious from the description, or may be learned by practice of the disclosed embodiments. The features and advantages of the disclosed embodiments will be realized and attained by the elements and combinations particularly pointed out in the appended claims.

It is to be understood that both the foregoing general description and the following detailed description are examples and explanatory only and are not restrictive of the disclosed embodiments as claimed.

The accompanying drawings constitute a part of this specification. The drawings illustrate several embodiments of the present disclosure and, together with the description, serve to explain the principles of the disclosed embodiments as set forth in the accompanying claims.

DETAILED DESCRIPTION

Examples of embodiments of the present disclosure are described with reference to the accompanying drawings. In the figures, which are not necessarily drawn to scale, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items or meant to be limited to only the listed item or items. It should also be noted that as used in the present disclosure and in the appended claims, the singular forms "a," "an," and "the" include plural references unless the context clearly dictates otherwise.

A need has been recognized to improve the isolation of debris and solid contaminants from fluid runoff within stormwater management crate arrays. Existing systems for isolating such debris may require intensive labor to install on a project site. For example, isolation systems may be cumbersome and heavy to manipulate into place. It may be difficult to assemble and install such isolation systems within stormwater management systems on a project site. Additionally, existing isolation systems may not isolate the debris and solid contaminants from the rest of the stormwater management crate array. Existing isolation systems may also be difficult to clean after installation.

The disclosed embodiments improve these and other deficiencies in existing isolation systems. For example, solutions are provided to reduce labor and assembly cost by reducing the difficulty in assembling and installing a weir, for isolation debris and solids, within a stormwater management crate. Other improvements include providing a weir that isolates the separated debris and solid sediments from the rest of the stormwater management crate array. The disclosed embodiments also allow for an easier method of cleaning the weir of separated debris and solid sediments. In addition, some disclosed embodiments allow for the weir to be installed within the column structure of the stormwater management crate array.

References will now be made in detail to the disclosed embodiments, examples of which are illustrated in the accompanying drawings.

Figure 1:
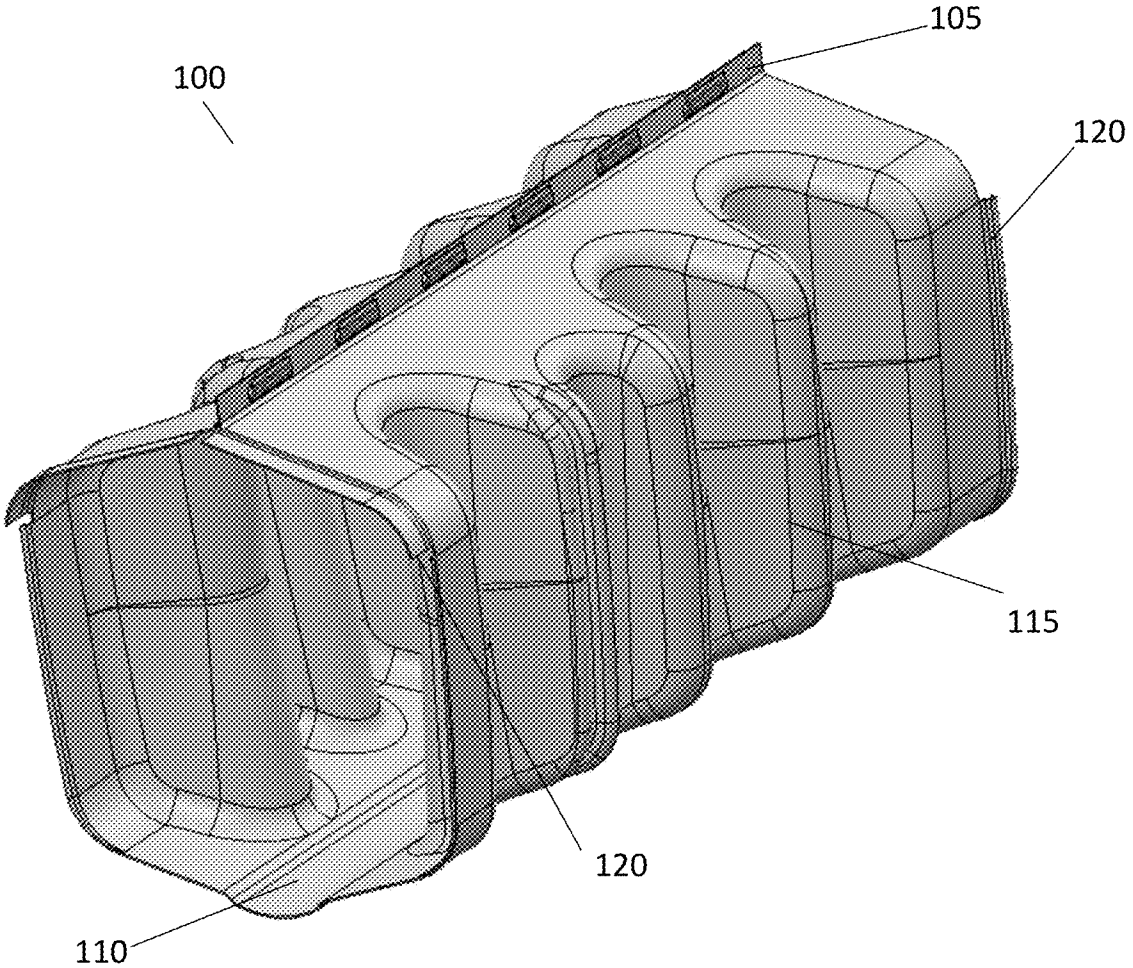
FIG. 1 depicts an isometric view of an example of a weir, consistent with various embodiments of the present disclosure.

FIG. 1 depicts an isometric view of an example of a weir 100. One or more weirs 100 may be connected together to form a modular set of weirs for use in a stormwater management crate array. Weir 100 may be configured to isolate a flow of stormwater from the stormwater management crate array. Further, debris and solid contaminants may settle out of the received flow of stormwater and be contained within weir 100 on all sides to prevent the debris and solid contaminants from entering other sections of the stormwater management crate array. In some embodiments, weir 100 may be constructed of plastic (e.g., polypropylene, HDPE, LDPE, PVC, polyethylene, polyurethane), metal, and/or any other suitable material. Plastic embodiments of weir 100 may be formed, for example, through injection molding, blow molding, CNC machining, vacuum forming, polymer casting, 3D printing, extrusion, rotational molding, or any other suitable means. In other embodiments, plastic embodiments of weir 100 may be thermoformed. The length and height of weir 100 may correspond to the length and the height of a stormwater management crate unit, such that weir 100 may fit within a stormwater management crate unit. In some embodiments, weir 100 may have a bottom 110. In some embodiments, bottom 110 may be flat and may be configured to be substantially parallel to a base plate of a stormwater management crate. Bottom 110 may provide a flat area for separated debris and solid contaminants to settle and may allow for an easier cleaning of weir 100 by a vacuum or other cleaning method. In other embodiments, bottom 110 may have a curved shape, e.g., a concave or a convex shape. In some embodiments, bottom 110 may be configured to mimic a shape of a bottom of stormwater management crate within which weir 100 is to be installed.

In some embodiments, weir 100 may have a plurality of column grooves 115. The plurality of column grooves 115 may comprise rounded indentations in weir 100. The plurality of column grooves 115 may be spaced at a distance along the length of weir 100 based on the location of structural columns in the stormwater management crate. For example, the plurality of column grooves 115 may be configured to extend around a plurality of columns located in the stormwater management crate. Accordingly, the size and spacing of the plurality of column grooves 115 may be associated with the size and spacing of the columns within the stormwater management crate. The plurality of column grooves 115 may maximize the amount of stormwater and debris that may be contained within weir 100 by providing additional space within weir 100 around the columns of the stormwater management crate.

In some embodiments, weir 100 may include one or more body connections 105. The one or more body connections 105 may be configured to connect a first side of weir 100 with a second side of weir 100 at the top of weir 100. The one or more body connections 105 may be snap connections, J-hook connections, cantilever snap connection, torsion snap connections, screws, bolts, rivets, or any other type of attachment suitable for connecting each side of weir 100. The one or more body connections 105 may be located at a top of weir 100, where the top of weir 100 is opposite bottom 110. In some embodiments, a single body connection 105 may extend along the length of the top of weir 100. In some embodiments the single body connection 105 may extend along the entire length of the top of weir 100.

In some embodiments, weir 100 may also include weir connection 120 at the first end and the second end of the weir 100. Weir connections 120 may be configured to connect a plurality of weirs 100 together to form a modular series of weirs 100 connected in end-to-end fashion. Weir connection 120 may be a snap connection, J-hook connection, cantilever snap connection, torsion snap connection, friction-fit connection, screw, bolt, rivet, or any other type of connection suitable for connecting one or more weirs 100 together. A plurality of weirs 100 may be connected together to form a longer modular weir system which may be installed in a stormwater management crate array comprising a row of stormwater management crate units. The weir connections 120 allow a modular weir system to be assembled to fit any length of stormwater management crate array.

In some embodiments, for example, a first weir, a second weir, and a third weir may be connected in an end-to-end-to-end fashion. Each of the first, second, and third weirs may have weir connection 120 at a first end and a weir connection 120 at a second end. For each of the first, second, and third weirs, the weir connection 120 at the first end may include a male connector and the weir connection 120 at the second end may include a female connector. When connected in an end-to-end-to-end fashion, the female connector at the second end of the first weir may be configured to mate with the male connector at the first end of the second weir, the female connector at the second end of the second weir may be configured to connect to the male connector at the first end of the third weir. In some embodiments, a series of connected weirs may include four weirs, five weirs, or more, and each additional weir may be configured to be connected in the same manner as the first, second, and third weirs, as discussed above.

Figure 2:
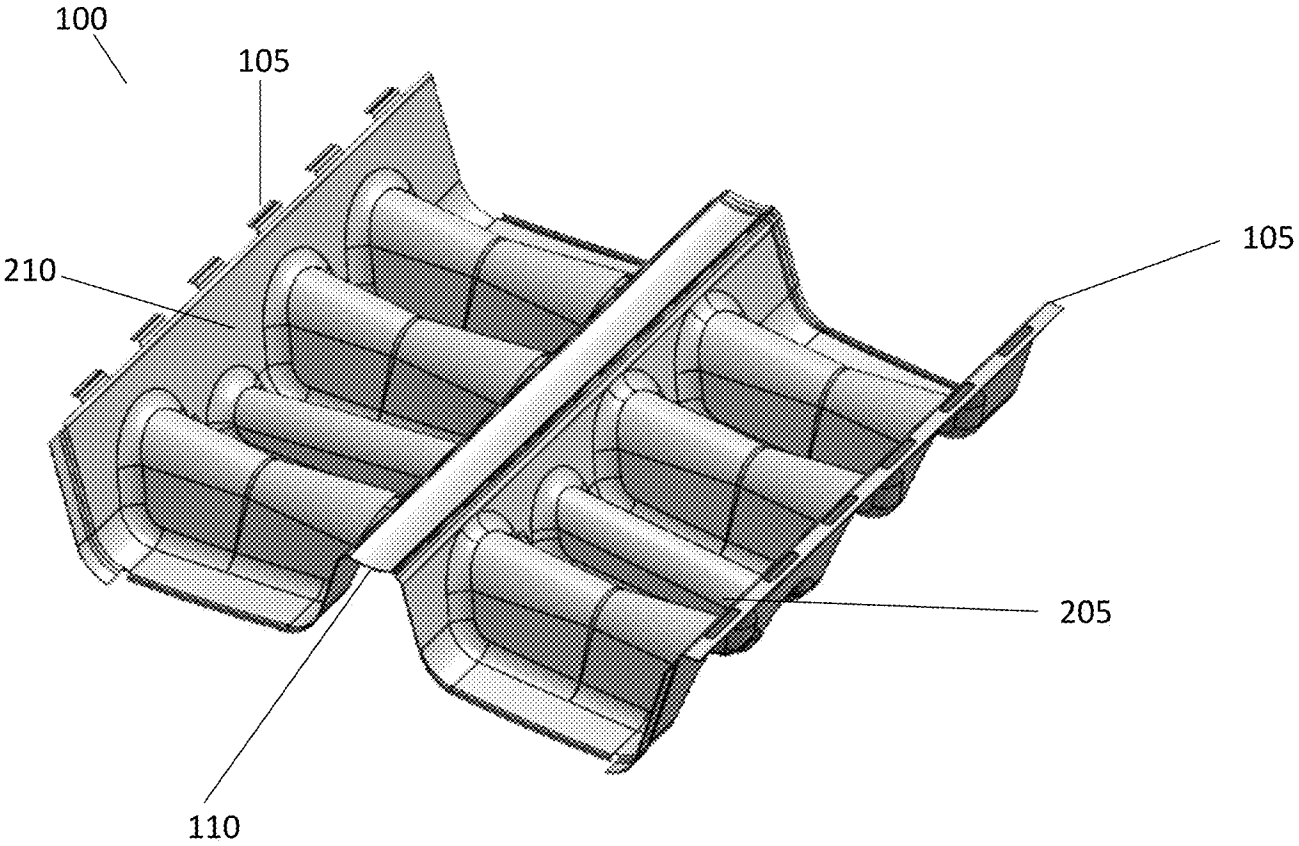
FIG. 2 depicts an example of an unassembled weir, consistent with various embodiments of the present disclosure.

FIG. 2 depicts an example of an embodiment of an unassembled weir 100. Weir 100 may be thermoformed in one continuous shape as shown in FIG. 2. Weir 100 may be assembled into its functional shape by folding first wall 205 and second wall 210 together above bottom 110. First wall 205 and second wall 210 may be connected using the plurality of body connections 105 to maintain weir 100 in its functional shape. Thermoforming weir 100 in the continuous shape as shown in FIG. 2 may reduce the time and cost of manufacturing weir 100.

Figure 3A:
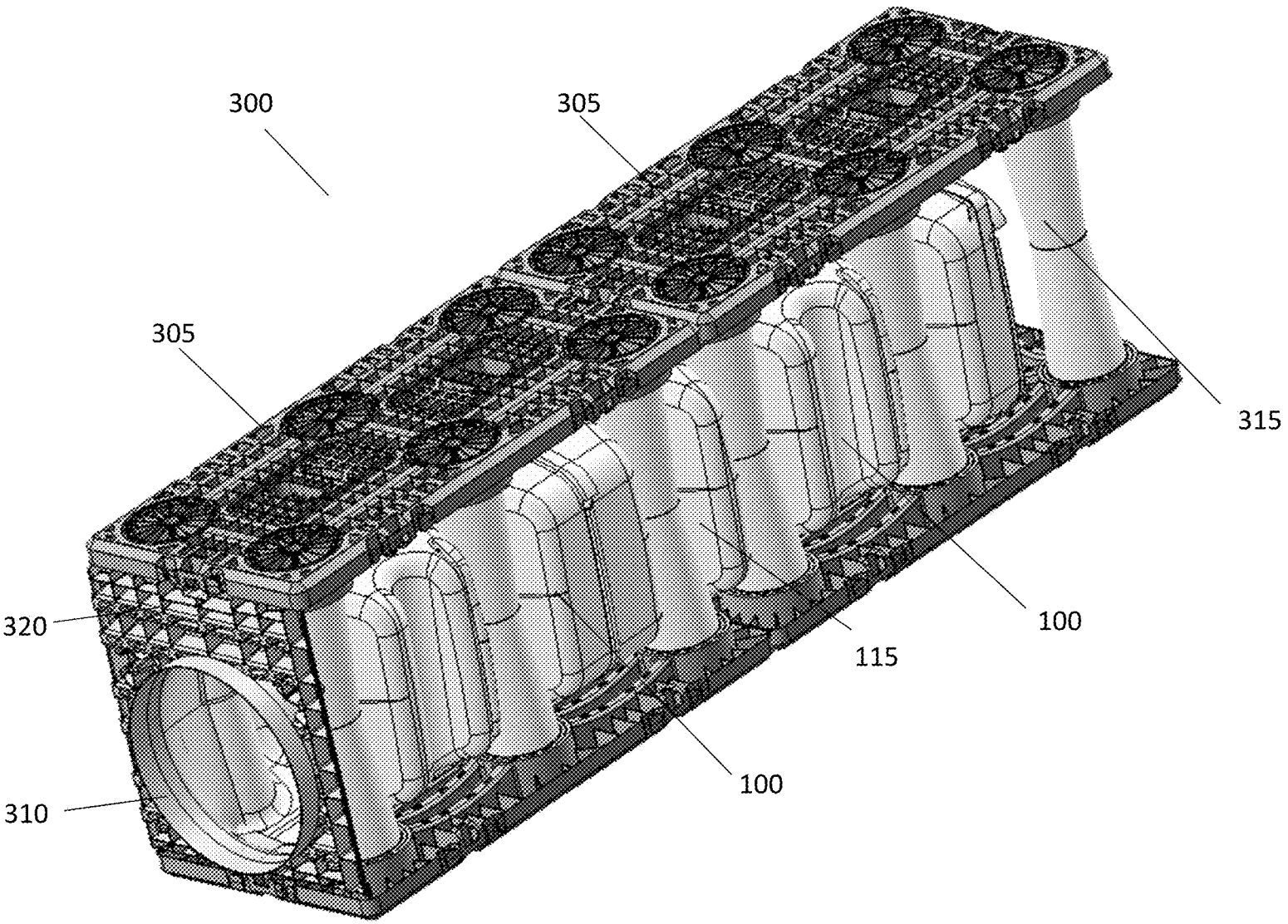
FIG. 3A depicts an example of a weir in an example of a stormwater management crate, consistent with various embodiments of the present disclosure.

FIG. 3A depicts an example of a modular weir 300 within two stormwater management crates 305. In FIG. 3A, modular weir 300 comprises two weirs 100 connected together in an end-to-end fashion. Column grooves 115 of each weir 100 may be configured to extend around a plurality of stormwater management crate columns 315. As depicted in FIG. 3A, the size and spacing of column grooves 115 may correspond to the size and spacing of stormwater management crate columns 315. Additionally, the height and length of weir 100 may correspond to the height and length of a stormwater management crate 305, such that weir 100 may be placed within stormwater management crate 305 to isolate a flow of water. Inlet 310 may be located at a first end of modular weir 300 and allow stormwater to enter modular weir 300. Inlet 310 may be configured to receive the runoff from one or more surface drains, such as a combination of spaced-part catch basins interconnected by buried pipes. Inlet 310 may be constructed of plastic (e.g., polypropylene, HDPE, LDPE, PVC, polyethylene, polyurethane), metal, and/or any other suitable material. Plastic embodiments of inlet 310 may be formed, for example, through injection molding, blow molding, CNC machining, vacuum forming, polymer casting, 3D printing, extrusion, rotational molding, or any other suitable means. In other embodiments, plastic embodiments of inlet 310 may be thermoformed. Inlet 310 may be installed through a side panel 320 of stormwater management crate 305. Side panel 320 of stormwater management crate 305 may include a circular opening with a diameter approximately equal to a diameter of inlet 310, such that inlet 310 may extend through side panel 320.

Figure 3B:
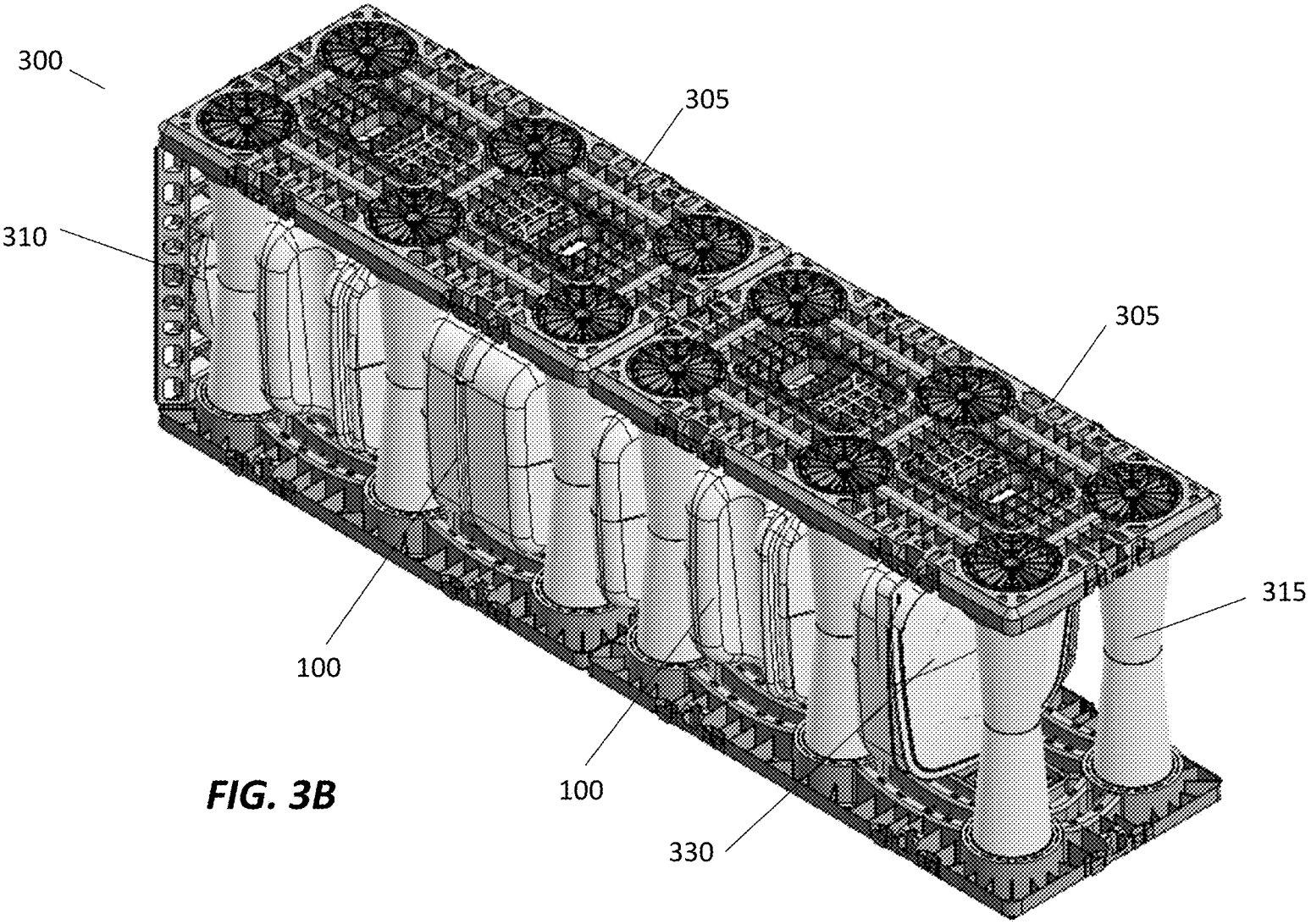
FIG. 3B depicts an example of a cap of a weir in an example of a stormwater management crate, consistent with various embodiments of the present disclosure.

FIG. 3B depicts an example of a modular weir 300 configured within an array of stormwater management crates 305 with modular weir 300 including cap 330. In FIG. 3B, modular weir 300 comprises two weirs 100 connected together and placed within two stormwater management crates 305. Cap 330, as depicted in FIG. 3B, may be located at a second end of modular weir 300 and may be configured to contain the flow of stormwater within modular weir 300. The second end of modular weir 300 may be an opposite end from inlet 310. Cap 330 may be constructed of plastic (e.g., polypropylene, HDPE, LDPE, PVC, polyethylene, polyurethane), metal, and/or any other suitable material. Plastic embodiments of cap 330 may be formed, for example, through injection molding, blow molding, CNC machining, vacuum forming, polymer casting, 3D printing, extrusion, rotational molding, or any other suitable means. In other embodiments, plastic embodiments of cap 330 may be thermoformed. The size and shape of cap 330 may correspond to the size and shape of weir 100, such that cap 330 may be connected to the second end of weir 100 to contain the flow of stormwater through modular weir 300.

Figure 4B:
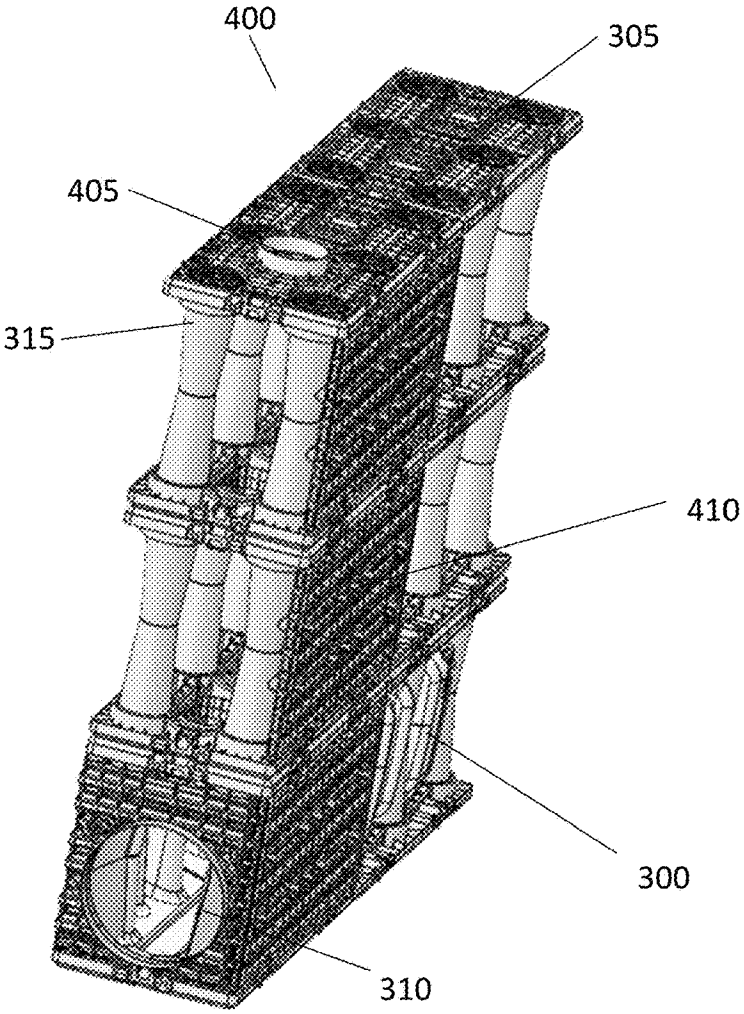
FIG. 4B depicts another example of a weir in an example of a stormwater management crate array with flat panels, consistent with various embodiments of the present disclosure.
Figure 4A:
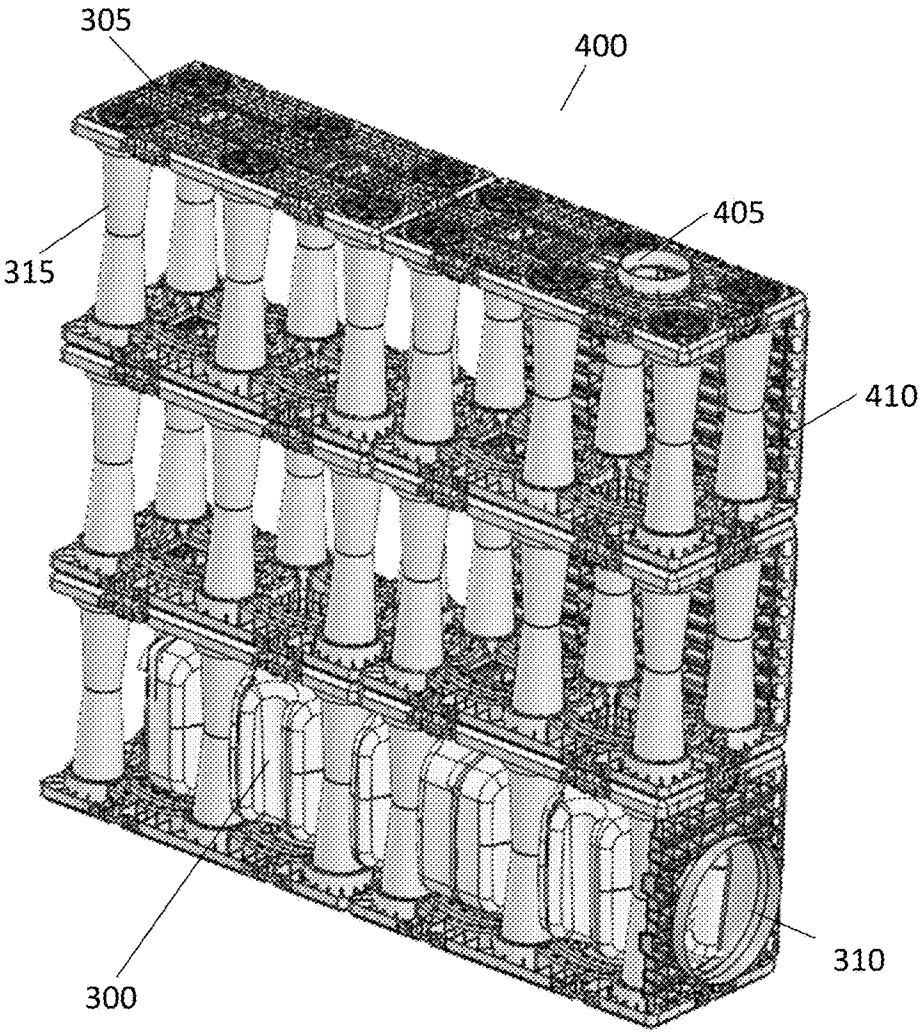
FIG. 4A depicts an example of an embodiment of a weir in an example of a stormwater management crate array with flat panels, consistent with various embodiments of the present disclosure.

FIG. 4A and FIG. 4B depict an example of modular weir 300 configured within a stormwater management crate array 400 with flat side panels 410. As depicted in FIGS. 4A and 4B, stormwater management crate array 400 may include rows of stormwater management crate units 305 stacked on top of each other. In such an embodiment, modular weir 300 may be located within the lowest row of stormwater management crate units 305. In some embodiments, stormwater may enter stormwater management crate array 400 through stormwater management crate inlet 405. Stormwater management crate inlet 405 may be configured to receive stormwater runoff from a surface-level drain. Stormwater management crate array 400 may include flat side panels 410. FIG. 4A and FIG. 4B depict only one column of flat side panels 410 on stormwater management crate array 400 for clarity and the entire outer perimeter of stormwater management crate array 400 may include flat side panels 410. In some embodiments, flat side panels 410 may be configured to provide structural support and stability to stormwater management crate array 400. A width of modular weir 300 may correspond to a width of stormwater management crate units 305 with flat side panels 410 attached, such that modular weir 300 may fit inside stormwater management crate units 305 with flat side panels 410 installed.

Figure 5B:
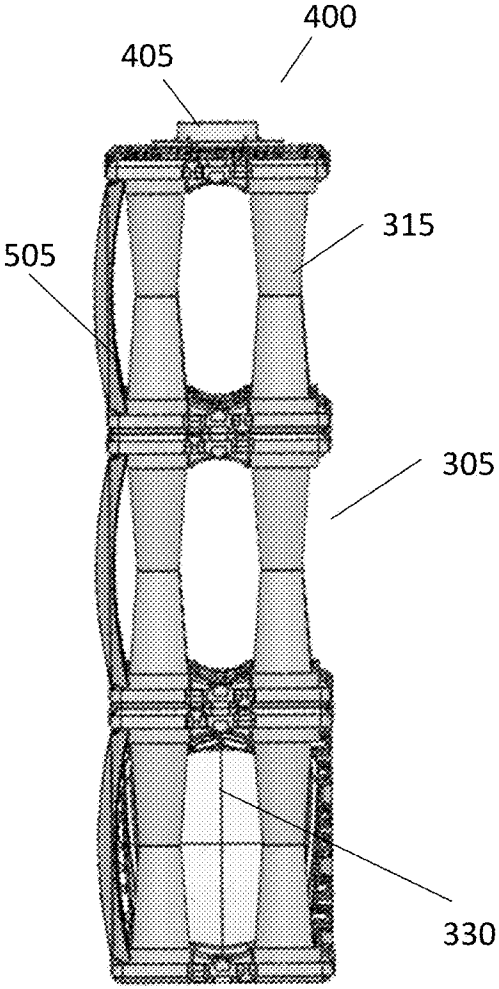
FIG. 5B depicts a side view of an example of a weir in an example of a stormwater management crate array with convex side panels, consistent with various embodiments of the present disclosure.
Figure 5A:
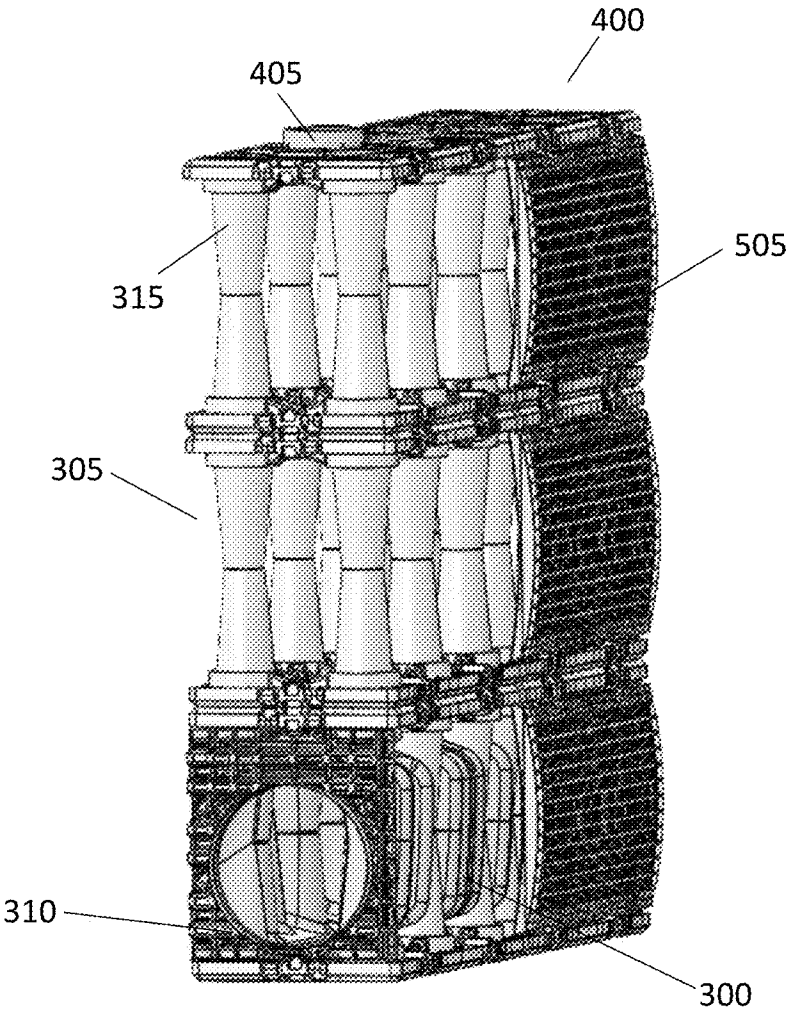
FIG. 5A depicts an isometric view of an example of a weir in an example of a stormwater management crate array with convex side panels, consistent with various embodiments of the present disclosure.

FIG. 5A and FIG. 5B depict an example of modular weir 300 in a stormwater management crate array 400 with convex side panels 505. Stormwater management crate array 400 may include rows of stormwater management crate units 305 stacked on top of each other. In such an embodiment, modular weir 300 may be located in the lowest row of stormwater management crate units 305. In some embodiments, stormwater may enter stormwater management crate array 400 through stormwater management crate inlet 405. Stormwater management crate inlet 405 may be configured to receive stormwater runoff from a surface-level drain. Stormwater management crate array 400 may include convex side panels 505. FIG. 5A and FIG. 5B depict only one column of convex side panels 505 on stormwater management crate array 400 for clarity, however, the entire outer perimeter of stormwater management crate array 400 may include convex side panels 505. In some embodiments, convex side panels 505 may be configured to provide structural support and stability to stormwater management crate array 400. A width of modular weir 300 may correspond to a width of stormwater management crate units 305 with convex side panels 505 attached, such the modular weir 300 may fit inside stormwater management crate units 305 with convex side panels 505 installed.

Figure 6C:
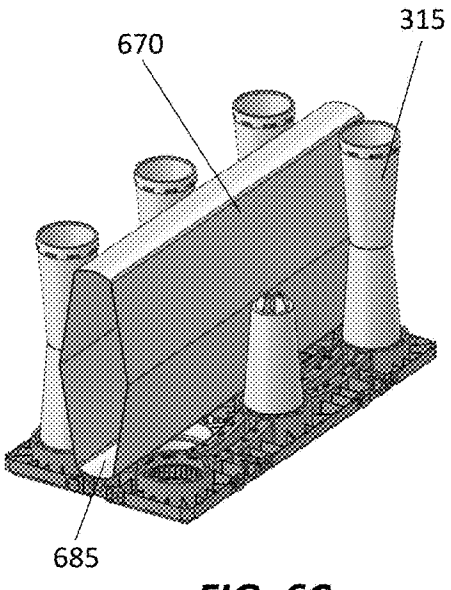
FIG. 6C depicts an example of a tubular weir, consistent with various embodiments of the present disclosure.
Figure 6B:
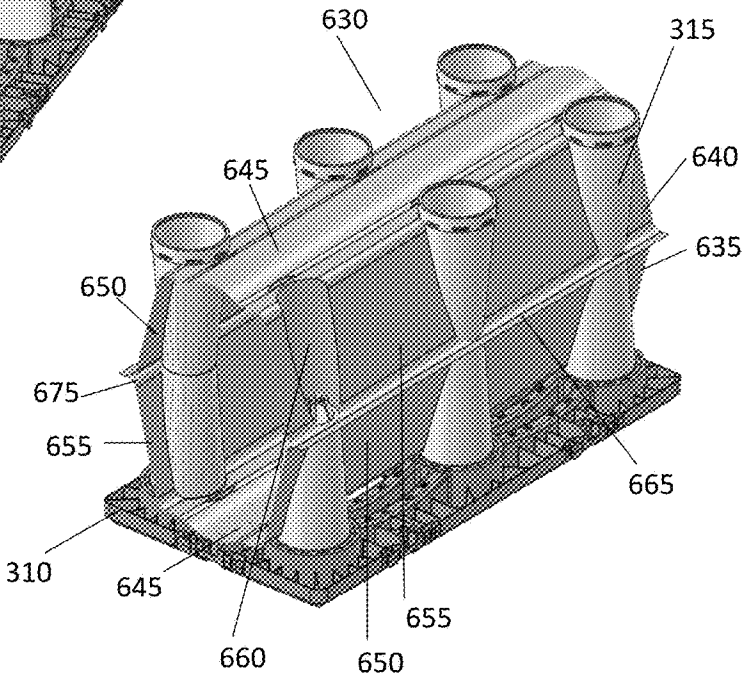
FIG. 6B depicts an example of a closed tray weir, consistent with various embodiments of the present disclosure.
Figure 6A:
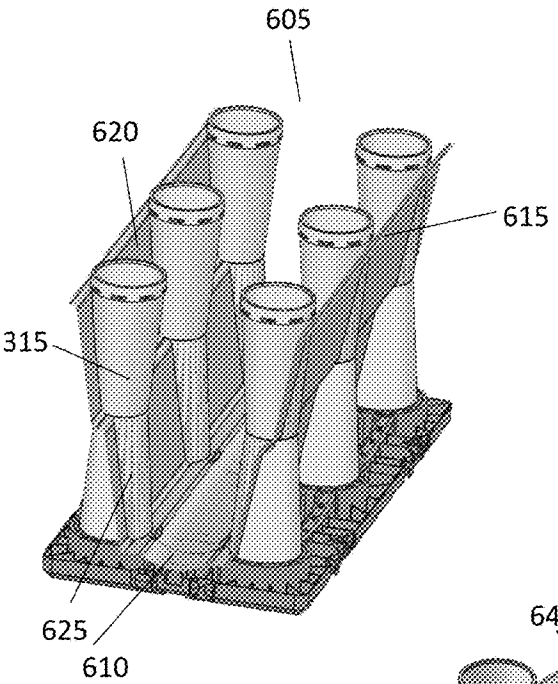
FIG. 6A depicts an example of an open tray weir, consistent with various embodiments of the present disclosure.

FIG. 6A depicts an example of an open tray weir 605. Open tray weir 605 may comprise a bottom 610, first wall 615, and second wall 620. Open tray weir 605 may be configured to isolate a flow of stormwater within a stormwater management crate array and allow debris and solid contaminants to separate from the isolated stormwater. The open top of open tray weir 605 may allow incoming stormwater to overflow out of open tray weir 605 when open tray weir 605 has filled with stormwater. While stormwater may overflow from open tray weir 605, debris and solid contaminants may separate from the stormwater in the open tray weir 605. Thus, separated debris and solid contaminants may be isolated from the remainder of the stormwater management crate array. Bottom 610 may correspond to bottom 110, as disclosed herein with respect to FIG. 1, and may similarly be flat in some embodiments or may have a curved shape in other embodiments. First wall 615 and second wall 620 may extend upwardly and outwardly from bottom 610. First wall 615 and second wall 620 may extend to the top of the plurality of stormwater management crate columns 315, such that open tray weir 605 may fit within a stormwater management crate unit. First wall 615 and second wall 620 may comprise a plurality of column grooves 625 that allow first wall 615 and second wall 620 to wrap directly around the plurality of stormwater management columns 315. Open tray weir 605 may be constructed of plastic (e.g., polypropylene, HDPE, LDPE, PVC, polyethylene, polyurethane), metal, and/or any other suitable material. Plastic embodiments of open tray weir 605 may be formed, for example, through injection molding, blow molding, CNC machining, vacuum forming, polymer casting, 3D printing, extrusion, rotational molding, or any other suitable means. In other embodiments, plastic embodiments of open tray weir 605 may be thermoformed. A plurality of open tray weirs 605 may be connected together in a row to form a longer open tray weir system that may correspond to a stormwater management crate array with a plurality of stormwater management crate units.

FIG. 6B depicts an example of a closed tray weir 630. Closed tray weir 630 may comprise a first tray 635, a second tray 640, first connection surface 665, and second connection surface 675. Each of first tray 635 and second tray 640 may comprise central surface 645. In some embodiments, central surface 645 of first tray 635 and central surface 645 of second tray 640 may be configured to be substantially parallel to a base plate 310 of a stormwater management crate. Central surface 645 of first tray 635 may provide a flat area for separated debris and solid contaminants to settle and may allow for an easier cleaning of closed tray weir 630 by a vacuum or other cleaning method. Central surface 645 of second tray 635 may be configured to contain stormwater within closed tray weir 630, keeping a flow of stormwater isolated from other stormwater management crates in a larger stormwater management crate array. In some embodiments, central surface 645 of first tray 635 may be curved. In some embodiments, central surface 645 of second tray 640 may be curved. In yet other embodiments, both central surface 645 of first tray 635 and central surface 645 of second tray 640 may be curved.

First tray 635 and second tray 640 may each further comprise a first wall 650 and a second wall 655. First wall 650 and second wall 655 may extend outwardly from central surface 645 at an angle from central surface 645, the central surface being configured to extend between first wall 650 and second wall 655. First wall 650 and second wall 655 may extend to approximately half the height of the plurality of stormwater management crate columns 315. When first tray 635 and second tray 640 are assembled, closed tray weir 630 may have a height approximately equal to the height of the plurality of stormwater management crate columns 315. First wall 650 and second wall 655 may comprise a plurality of column grooves 660 that allow first wall 650 and second wall 655 to wrap around the plurality of stormwater management columns 315.

First connection surface 665 may be located at an end of first wall 650 of first tray 635 and at an end of second wall 655 of second tray 640, first connection surface 665 being configured to connect first tray 635 to second tray 640. Second connection surface 675 may be located at an end of second wall 655 of first tray 635 and at an end of first wall 650 of second tray 640, second connection surface 675 being configured to connect first tray 635 to second tray 640. First tray 635 and second tray 640 may be connected at first connection surface 665 and second connection surface 675 through a variety of methods including, but not limited to, snap connections, J-hook connections, cantilever snap connection, friction-fit connections, torsion snap connections, screws, bolts, rivets, or any other type of attachment suitable for connecting first tray 635 and second tray 640. When closed tray weir 630 is assembled by connecting first tray 635 to second tray 640 at first connection surface 665 and second connection surface 675, closed tray weir 630 may be configured to isolate a flow of stormwater within a stormwater management crate array to allow debris and solid contaminants to settle from the flow of stormwater. In some embodiments, first wall 635 and second wall 640 of each of first tray 635 and second tray 640 may comprise a plurality of column grooves 660 configured to wrap around the plurality of columns 315 in the stormwater management crate.

Closed tray weir 630 may be constructed of plastic (e.g., polypropylene, HDPE, LDPE, PVC, polyethylene, polyurethane), metal, and/or any other suitable material. Plastic embodiments of closed tray weir 630 may be formed, for example, through injection molding, blow molding, CNC machining, vacuum forming, polymer casting, 3D printing, extrusion, rotational molding, or any other suitable means. In other embodiments, plastic embodiments of closed tray weir 630 may be thermoformed.

A plurality of closed tray weirs 630 may be connected together in a row to form a longer closed tray weir system that may correspond to a stormwater management crate array with a plurality of stormwater management crate units. Further, an inlet may be placed on a first end of closed tray weir 630 to direct a flow of stormwater into closed tray weir 630. The size and shape of the inlet may correspond to the size and shape of closed tray weir 630, such that the inlet may be connected to an open end of closed tray weir 630. Additionally, a cap (not shown in FIG. 6B) may be located at a second end of closed tray weir 630 and may be configured to contain the flow of stormwater within closed tray weir 630. The second end of closed tray weir 630 may be an opposite end from the inlet. The size and shape of the cap may correspond to the size and shape of closed tray weir 630, such that the cap may be connected to the second end of closed tray weir 630 to contain the flow of stormwater through closed tray weir 630.

FIG. 6C depicts an example of a tubular weir 670. Tubular weir 670 may be configured to isolate a flow of stormwater within a stormwater management crate array to allow debris and solid contaminants to settle from the flow of stormwater. Tubular weir 670 may be tubular in shape, and may comprise a hollow tube made of plastic, metal, or any other material suitable for forming a tubular weir 670. In some embodiments, tubular weir 670 may be blow molded, twin sheet thermoformed, or extruded. The width of tubular weir 670 may be approximately equal to the distance between the plurality of stormwater management crate columns 315 and a height of tubular weir 670 may be approximately equal to a height of the plurality of stormwater management crate columns 315, such that tubular weir 670 may fit between the plurality of stormwater management crate columns 315. In some embodiments, tubular weir 670 may comprise a bottom 685, wherein bottom 685 is flat and is substantially parallel to a base plate of the stormwater management crate. In other embodiments, bottom 685 may have a curved shape.

A plurality of tubular weirs 670 may be connected together in a row to form a longer tubular weir system that may correspond to a stormwater management crate array with a plurality of stormwater management crate units. Further, an inlet may be placed on a first end of tubular weir 670 to direct a flow of stormwater into tubular weir 670. The size and shape of the inlet may correspond to the size and shape of tubular weir 670, such that the inlet may be connected to an open end of tubular weir 670. Additionally, a cap (not shown in FIG. 6C) may be located at a second end of tubular weir 670 and may be configured to contain the flow of stormwater within tubular weir 670. The second end of tubular weir 670 may be an opposite end from the inlet. The size and shape of the cap may correspond to the size and shape of tubular weir 670, such that the cap may be connected to the second end of tubular weir 670 to contain the flow of stormwater through tubular weir 670.

Figure 7B:
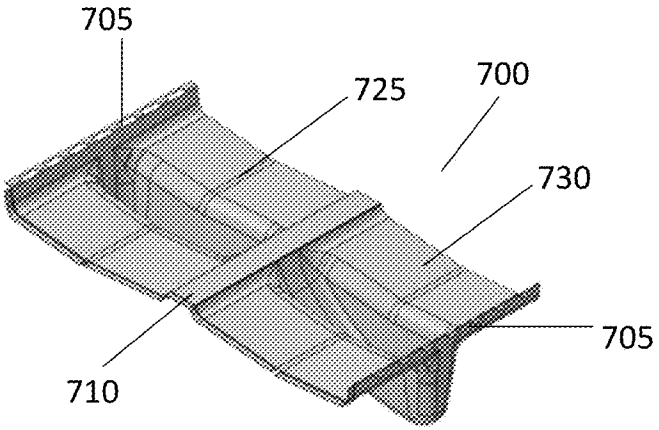
FIG. 7B depicts an example of an unassembled weir, consistent with various embodiments of the present disclosure.
Figure 7A:
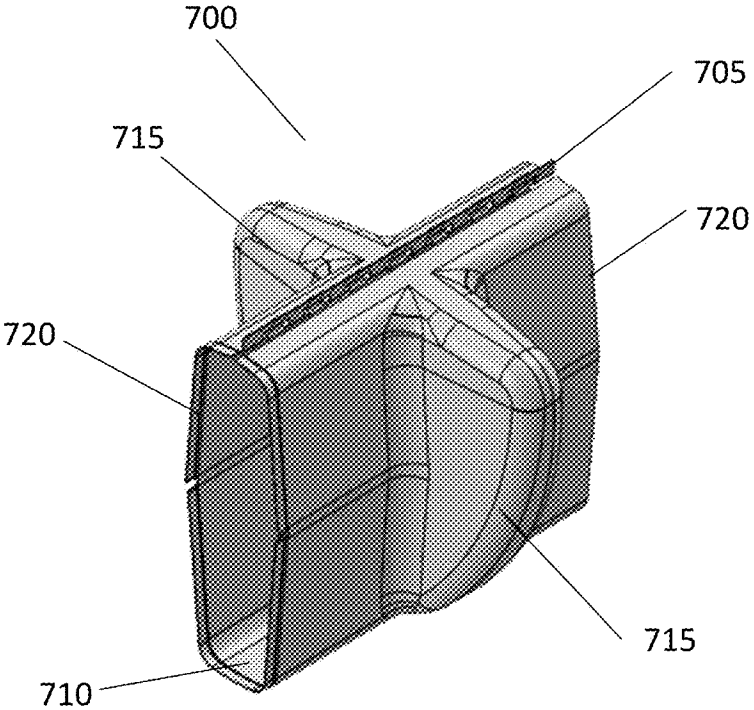
FIG. 7A depicts an example of a weir, consistent with various embodiments of the present disclosure.

FIG. 7A depicts an example of a weir 700. One or more weirs 700 may be used to form a modular weir for use in a stormwater management box system. Weir 700 may be configured to isolate a flow of water from the stormwater management box system. Weir 700 may contain debris and solid contaminants that have separated from the stormwater runoff to prevent the debris and solid contaminants from entering other sections of the stormwater management box system. In some embodiments, weir 700 may be constructed of plastic (e.g., polypropylene, HDPE, LDPE, PVC, polyethylene, polyurethane), metal, and/or any other suitable material. Plastic embodiments of weir 700 may be formed, for example, through injection molding, blow molding, CNC machining, vacuum forming, polymer casting, 3D printing, extrusion, rotational molding, or any other suitable means. In other embodiments, plastic embodiments of weir 700 may be thermoformed. The length and height of weir 700 may correspond to the length and the height of a stormwater management box. In some embodiments, weir 700 may have a bottom 710. In some embodiments, bottom 710 may be flat and may be configured to be substantially parallel to a base plate of a stormwater management box. Bottom 710 may provide a flat area for separated debris and solid contaminants to settle and may allow for an easier cleaning of modular weir 700 by a vacuum or other cleaning method. In other embodiments, bottom 710 may be curved.

In some embodiments, weir 700 may have a column extension 715. Column extension 715 may extend at a right angle from weir 700. Column extension 715 may be configured to fit between columns in a stormwater management box or crate. Accordingly, the height and width of column extension 715 may be associated with the height and spacing of columns within a stormwater management box assembly. Column extension 715 may maximize an amount of stormwater and debris that may be contained within weir 700 by providing additional space within weir 700 between the columns of a stormwater management box or crate.

In some embodiments, weir 700 may include one or more body connections 705. The one or more body connections 705 may be configured to connect each side of weir 700 at the top of weir 700. The plurality of body connections 705 may comprise snap connections, J-hook connections, cantilever snap connection, torsion snap connections, screws, bolts, rivets, or any other type of attachment suitable for connecting each side of weir 700. The one or more body connections 705 may be located at a top of weir 700, where the top of weir 700 is opposite bottom 710.

In some embodiments, weir 700 may also include weir connection 720 at a first end and weir connection 720 at a second end of the weir 700. Weir connection 720 may be configured to connect a plurality of weirs 700 together in an end-to-end fashion to form a modular weir. Weir connection 720 may be a snap connection, J-hook connection, friction-fit connection, cantilever snap connection, torsion snap connection, screw, bolt, rivet, or any other type of connection suitable for connecting one or more weir 700. In some embodiments, weir connection 720 at a first end of weir 700 may include a male portion, while weir connection 720 at a second end of weir 700 may include a female portion, the male portion of a first weir being configured to mate with a female portion of a second weir.

In some embodiments, weir 700 may include an inlet configured to allow stormwater to enter isolator unit 700. The inlet may be configured to connect to an opening in a first or second end of weir 700. The inlet may be installed through a side panel of a stormwater box or crate which may allow a flow of water to enter through the side panel into weir 700. In some embodiments, weir 700 may also include a cap (not shown in FIG. 7A) located at a second end of weir 700 and may be configured to contain the flow of stormwater within weir 700. The second end of weir 700 may be an opposite end from the inlet. The size and shape of the cap may correspond to the size and shape of weir 700, such that the cap may be connected to the second end of weir 700 to contain the flow of stormwater.

FIG. 7B depicts an example of an embodiment of an unassembled weir 700. Weir 700 may be thermoformed in one continuous shape as shown in FIG. 7B. Weir 700 may be assembled into its functional shape by folding first wall 725 and second wall 730 together above bottom 710. First wall 725 and second wall 730 may be connected using the one or more body attachments 705 to maintain weir 700 in its functional shape, i.e., its shape for use within a stormwater management box or crate.

Figure 7C:
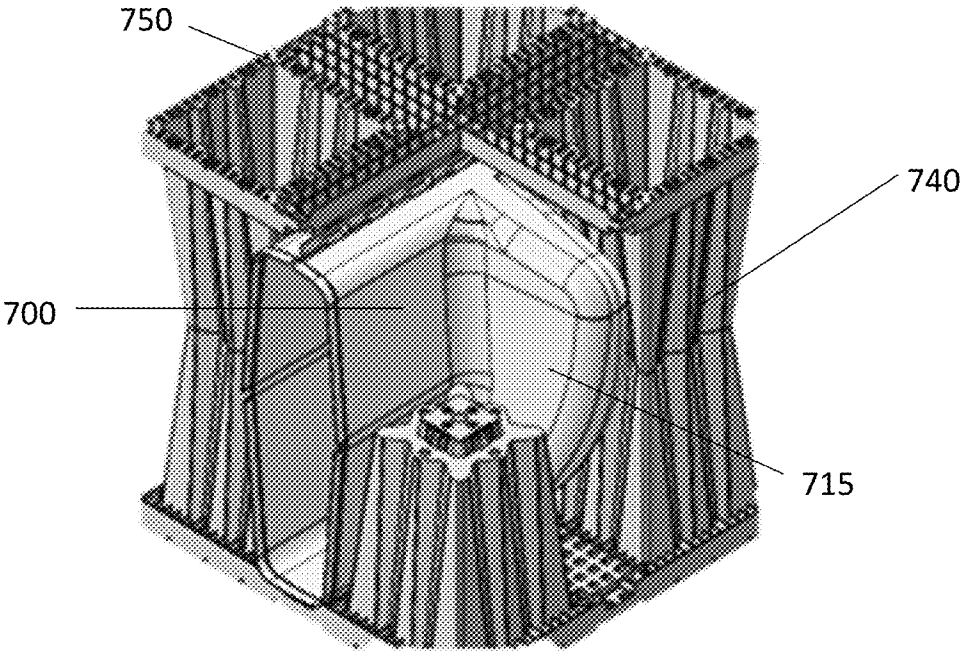
FIG. 7C depicts an example of a weir in a stormwater management box, consistent with various embodiments of the present disclosure.

FIG. 7C depicts an example of weir 700 in a stormwater management box unit 750. In such an embodiment, stormwater management box unit 750 may comprise four stormwater management box columns 740. Column extension 715 may extend at a right angle from weir 700 to extend between stormwater management box columns 740. As depicted in FIG. 7C, the length and width of column extension 715 may correspond to the size and spacing of stormwater management box columns 740. Additionally, a height and length of weir 700 may correspond to a height and length of a stormwater management box unit 750, such that weir 700 may be placed within stormwater management box unit 750 to isolate a flow of water. Although FIG. 7C shows one stormwater management box unit 750 and one weir 700, a larger stormwater management box array may be assembled by connecting one or more stormwater management box units 750 and including one or more weirs 700 within one row of the stormwater management box array.

Figure 8B:
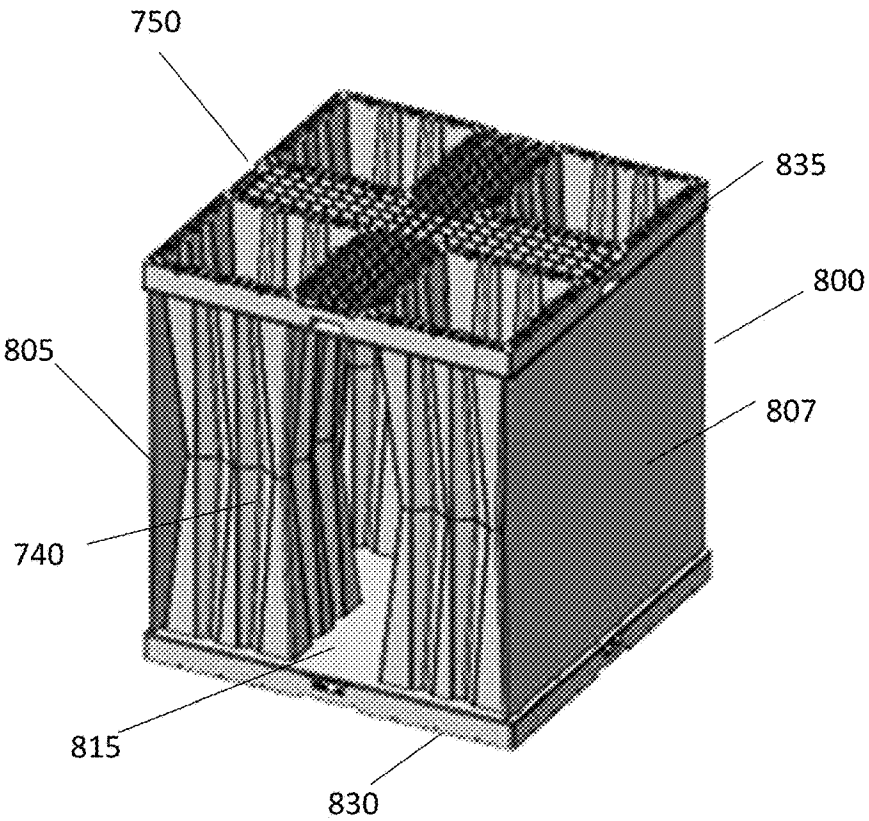
FIG. 8B depicts an example of a flat sheet weir in a stormwater management box, consistent with various embodiments of the present disclosure.
Figure 8A:
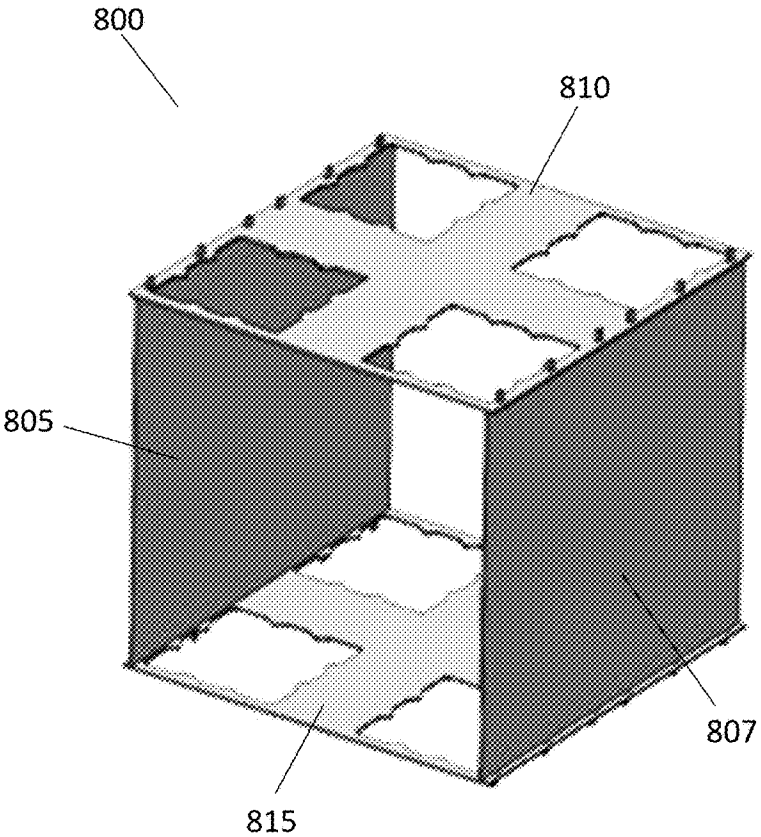
FIG. 8A depicts an example of a flat sheet weir, consistent with various embodiments of the present disclosure.

FIG. 8A depicts an example of a flat sheet weir 800. Flat sheet weir 800 may be configured to encompass a stormwater management box unit from outside the plurality of stormwater management box columns. Flat sheet weir 800 may comprise a top column panel 810, a bottom column panel 815, a first side panel 805 and a second side panel 807. Flat sheet weir 800 may be made of plastic, metal, or any other material suitable for forming a flat sheet weir 800. First side panel 805 and second side panel 807 may comprise flat, solid walls on two sides of flat sheet weir 800. Top column panel 810 and bottom column panel 815 may each comprise a flat surface with a plurality of openings, wherein the plurality of openings are configured to fit around a plurality of stormwater management box columns. A height and length of first side panel 805, second side panel 807, top column panel 810, and bottom column panel 815 may correspond to a height and length of a stormwater management box. Further, the size and spacing of the plurality of openings in top column panel 810 and bottom column panel 815 may correspond to the size and spacing of a plurality of columns in a stormwater management box. First side panel 805 and second side panel 807 may be connected to top column panel 810 and bottom column panel 815 using snap connections, J-hook connections, cantilever snap connections, torsion snap connections, screws, bolts, rivets, or any other type of connection suitable for connecting first side panel 805 and second side panel 807 to top column panel 810 and bottom column panel 815.

FIG. 8B depicts an example of a flat sheet weir 800 in a stormwater management box 750. As depicted in FIG. 8B, flat sheet weir 800 may be placed such that first side panel 805 and second side panel 807 are located outside stormwater management box columns 740. Top column panel 810 may be placed below stormwater management box top plate 835. Bottom column panel 815 may be placed above stormwater management box base plate 830. The plurality of stormwater management columns 740 may be placed within the plurality of openings in top column panel 810 and bottom column panel 815 such that the plurality of stormwater management columns 740 may be properly attached to stormwater management base plate 830 and stormwater management top plate 835. In such an embodiment, flat sheet weir 800 may isolate water within stormwater management box 750 by fully enclosing the plurality of stormwater management box columns 740. Such an embodiment may maximize an amount of stormwater that may be isolated within flat sheet weir 800. Although FIG. 8B shows one stormwater management box 750 and one flat sheet weir 800, a larger stormwater management box array may be assembled by connecting a plurality of stormwater management boxes 750 and including a plurality of flat sheet weirs 800 around one row of the stormwater management box assembly.

In some embodiments, flat sheet weir 800 may include an inlet configured to allow stormwater to enter flat sheet weir 800. The inlet may be of the same size and shape as flat sheet weir 800, such that the inlet may connected to one end of flat sheet weir 800. The inlet may be installed through a side panel of a stormwater management box unit which may allow a flow of water to enter through the side panel into flat sheet weir 800. In some embodiments, flat sheet weir 800 may also include a cap (not shown in FIG. 8B) located at a second end of flat sheet weir 800 and may be configured to contain the flow of stormwater within flat sheet weir 800. The second end of flat sheet weir 800 may be an opposite end from the inlet. The size and shape of the cap may correspond to the size and shape of flat sheet weir 800, such that the cap may be connected to the second end of flat sheet weir 800 to contain the flow of stormwater.

Figure 9B:
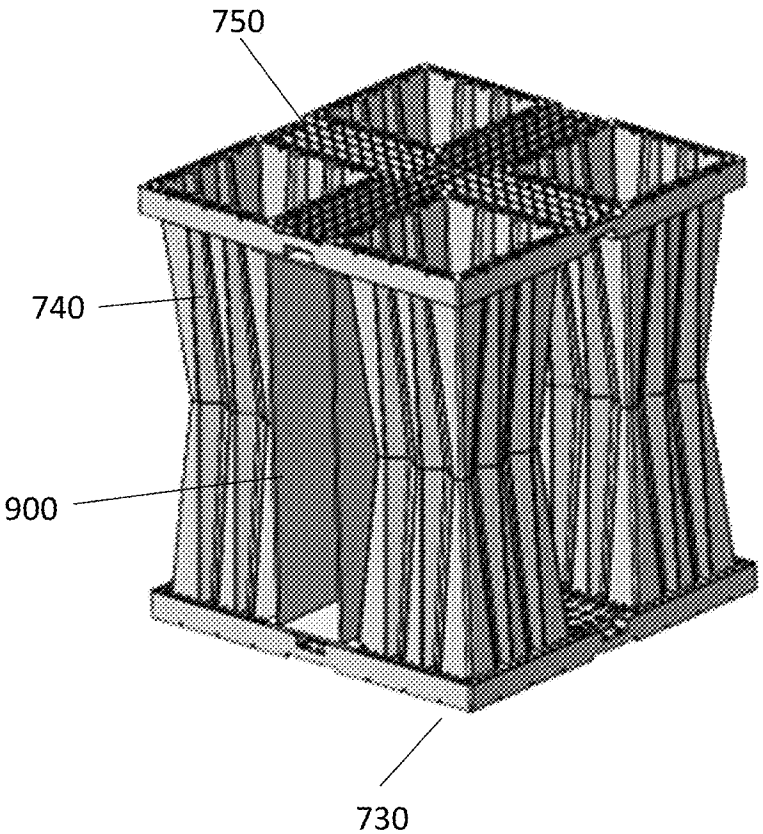
FIG. 9B depicts an example of a flat sheet weir for inside columns in a stormwater management box, consistent with various embodiments of the present disclosure.
Figure 9A:
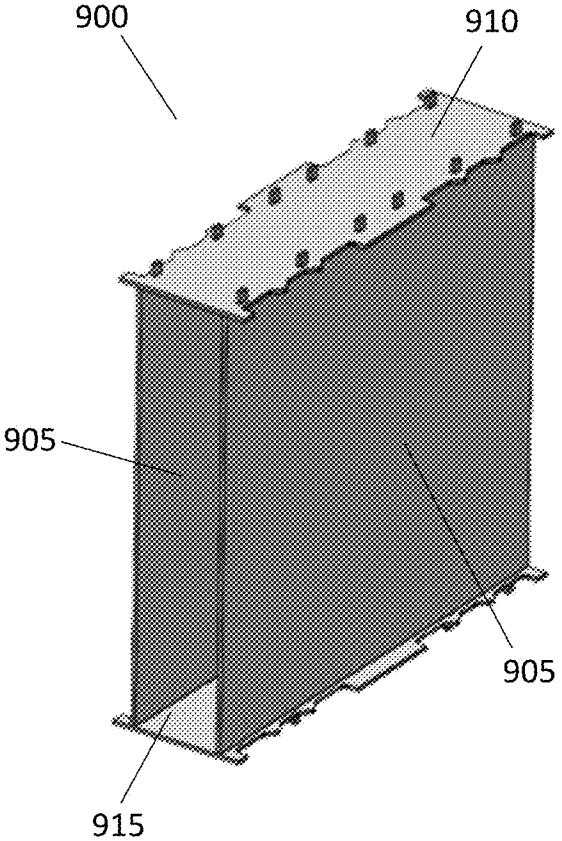
FIG. 9A depicts an example of a flat sheet weir for inside columns of a stormwater management box, consistent with various embodiments of the present disclosure.

FIG. 9A depicts an example of a flat sheet weir 900. Flat sheet weir 900 may comprise weir side panels 905, weir top panel 910, and weir bottom panel 915. Weir side panels 905, weir top panel 910, and weir bottom panel 915 may comprise solid walls that create a rectangular tube. Flat sheet weir 900 may be made of plastic, metal, or any other material suitable for forming a flat sheet weir 900. The height of weir side panels 905 and the width of weir top panel 910 and weir bottom panel 915 may be associated with the height and spacing of the plurality of columns located within a stormwater management box. The length of flat sheet weir 900 may correspond to a length of a stormwater management box. Weir side panels 905 may be connected to weir top panel 910 and weir bottom panel 915 using snap connections, J-hook connections, cantilever snap connections, torsion snap connections, screws, bolts, rivets, or any other type of connection suitable for connecting weir side panels 905 to weir top panel 910 and weir bottom panel 915.

FIG. 9B depicts an exemplary flat sheet weir 900 in stormwater management box 750. As depicted in FIG. 9B, flat sheet weir 900 may be placed within the plurality of stormwater management box columns 740. In such an embodiment, flat sheet weir 900 may isolate water within stormwater management box 750 within the plurality of stormwater management box columns 740. Although FIG. 9B shows one stormwater management box 750 and one flat sheet weir 900, a larger stormwater management box array may be assembled by connecting a plurality of stormwater management boxes 750 and including a plurality of flat sheet weirs 900 within the stormwater management box assembly.

In some embodiments, flat sheet weir 900 may include an inlet configured to allow stormwater to enter flat sheet weir 900. The inlet may be of the same size and shape as flat sheet weir 900, such that the inlet may be connected to one end of flat sheet weir 900. The inlet may be installed through a side panel of a stormwater management box unit which may allow a flow of water to enter through the side panel into flat sheet weir 900. In some embodiments, flat sheet weir 900 may also include a cap (not shown in FIG. 9B) located at a second end of flat sheet weir 900 and may be configured to contain the flow of stormwater within flat sheet weir 900. The second end of flat sheet weir 900 may be an opposite end from the inlet. The size and shape of the cap may correspond to the size and shape of flat sheet weir 900, such that the cap may be connected to the second end of flat sheet weir 900 to contain the flow of stormwater.

Figure 10:
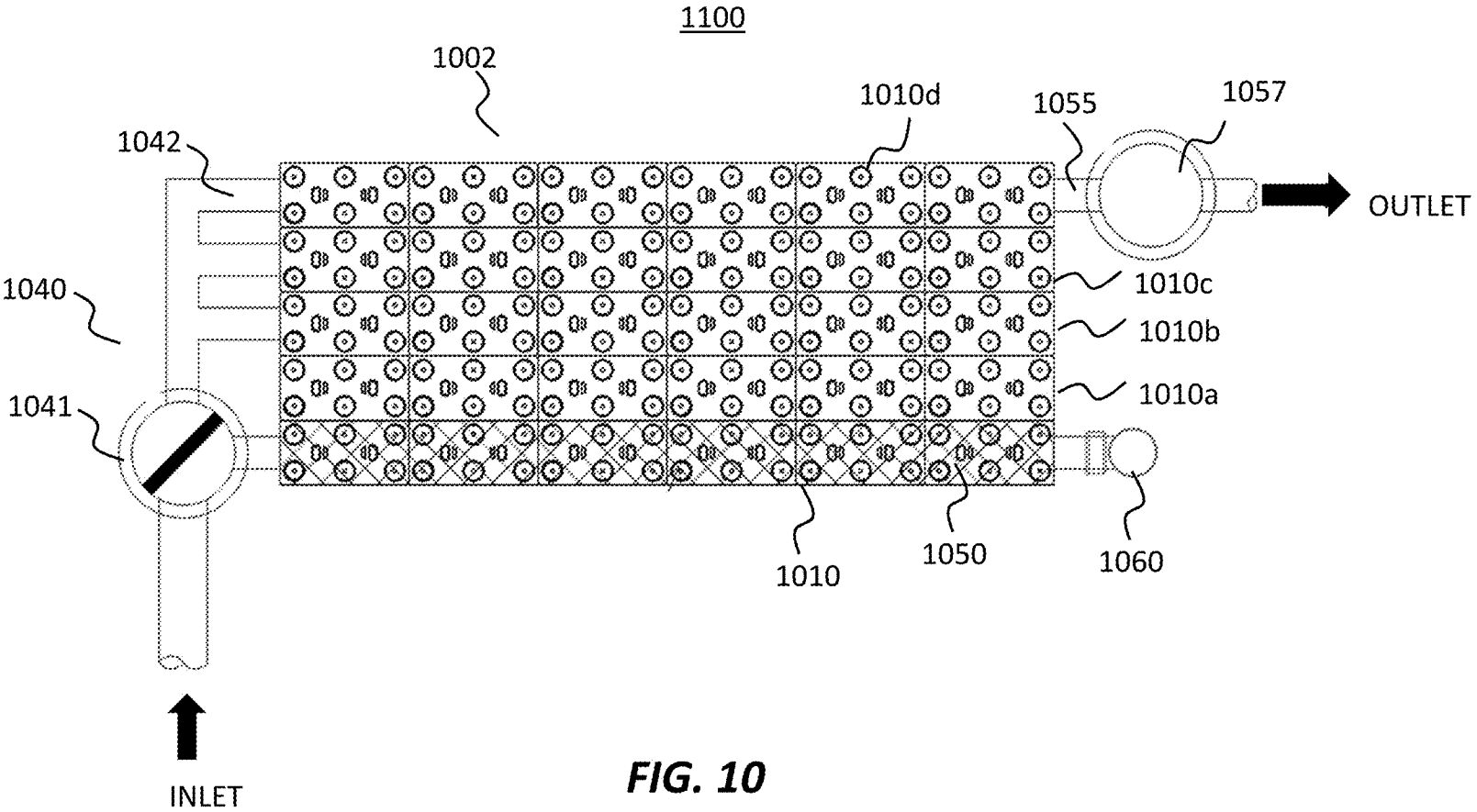
FIG. 10 depicts a top plan view of an example of a stormwater management system with a weir, consistent with various embodiments of the present disclosure.

FIG. 10 depicts a top plan view schematic of an example of a stormwater management system 1100. Systems 1100 may include an array 1002 of stormwater management crates 1010 arranged side-by-side in rows. In the embodiment depicted in FIG. 10, array 1002 may include a first row of stormwater management crates 1010 and additional rows of stormwater management crates 1010*a*-1010*d*, all of which may have similar shapes and dimensions. However, any suitable number of stormwater management crates may be utilized within system 1100. Each stormwater management crate 1010 of array 1002 may be a crate comprising a top plate, a plurality of columns, and a bottom plate. The outer perimeter of array 1002 may include a plurality of side panels configured to provide stability and structural support to array 1002. Array 1002 may be wrapped in a filtration fabric configured to be situated beneath at least a portion of array 1002 and may be configured to capture sediment form the runoff in array 1002. The array 1002 may also include a nonwoven geotextile fabric, bituminous covering, synthetic polymer plastic sheeting, or other suitable geotextile fabrics configured to cover the exterior surface of the side panels of the array 1002. The stormwater management crates of array 1002 may be configured to receive and temporarily store rainwater and other fluids from one or more surface level drains. Over time, the stormwater management crates may disperse the runoff stored therein by percolation into the surrounding water permeable media through the lattice structure of the side panels, top plates, and bottom plates.

Stormwater management system 1100 may include a subterranean inlet apparatus 1040 configured to receive the runoff from one or more surface drains, such as a combination of spaced-part catch basins interconnected by buried pipes. In some embodiments, runoff from the surface drains may flow through one or more settling devices before entering inlet apparatus 1040, in order to settle out solids and floating matter. Inlet apparatus 1040 may optionally include a diverter 1041 configured to direct the received runoff into the first row of stormwater management crates 1010 in the chamber array 1002. A modular weir 1050 may be located in the first row of stormwater management crates 1010. Modular weir 1050 may be configured to isolate the received runoff from additional rows of stormwater management crates 1010*a*-1010*d*. Modular weir 1050 may comprise any of the modular weirs disclosed herein. Sediment and solid debris may separate from the runoff within modular weir 1050, preventing such sediment and solid debris from entering the additional rows of stormwater management crates 1010*a*-1010*d*. In some embodiments, water isolated within modular weir 1050 may exit modular weir 1050 and enter the additional rows of stormwater management crates 1010*a*-1010*d* by leaking out of the connection points throughout modular weir 1050.

In some embodiments, when the first row of stormwater management crates 1010 is full, or otherwise unable to receive additional runoff, diverter 1041 may direct runoff to an inlet manifold 1042 for delivery into one or more additional rows of stormwater management crates 1010*a*-1010*d* of the chamber array 1002. Diverter 1041 may include an elevated bypass manifold and/or an overflow weir that may create a differential between the first row of stormwater management crates 1010 and the rest of the chamber array 1002, thus allowing modular weir 1050 located in the first row of stormwater management crates 1010 to settle and filter the received runoff. Optionally, one or more rows of stormwater management crates in array 1002 may include an outflow pipe 1055 configured to discharge runoff from the chambers at a predetermined rate via an outlet control structure 1057 (which may include, e.g., a fluid valve). The outlet may discharge runoff to a municipal storm sewer, pond, watercourse, or other receiving point via an underground drainage structure. The first row of stormwater management crates 1010 containing modular weir 1050 may further comprise a cleanout structure 1060. Cleanout structure 1060 may allow access to modular weir 1050 for cleaning settled debris and solid contaminants contained in modular weir 1050

The foregoing description has been presented for purposes of illustration. It is not exhaustive and is not limited to precise forms or embodiments disclosed. Modifications and adaptations of the embodiments will be apparent from consideration of the specification and practice of the disclosed embodiments. For example, while certain components have been described as being coupled to one another, such components may be integrated with one another or distributed in any suitable fashion.

Moreover, while illustrative embodiments have been described herein, the scope includes any and all embodiments having equivalent elements, modifications, omissions, combinations (e.g., of aspects across various embodiments), adaptations and/or alterations based on the present disclosure. The elements in the claims are to be interpreted broadly based on the language employed in the claims and not limited to examples described in the present specification or during the prosecution of the application, which examples are to be construed as nonexclusive. Further, the steps of the disclosed methods can be modified in any manner, including reordering steps and/or inserting or deleting steps.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents may be resorted to, falling within the scope of the disclosure.

Other embodiments will be apparent from consideration of the specification and practice of the embodiments disclosed herein. It is intended that the specification and examples be considered as example only, with a true scope and spirit of the disclosed embodiments being indicated by the following claims.

What is claimed is:

1. A modular weir configured to isolate suspended solids from a flow of water in a stormwater management crate, the modular weir comprising:

a plurality of weirs connected together, the plurality of weirs being configured to isolate the flow of water from the stormwater management crate;

a plurality of column grooves along the plurality of weirs configured to extend around a plurality of columns in the stormwater management crate;

an inlet located at a first end of the plurality of weirs configured to receive the flow of water within the stormwater management crate; and a cap located at a second end of the plurality of weirs configured to contain the flow of water within the modular weir;

wherein each of the plurality of weirs comprise a flat bottom configured to collect the suspended solids from the flow of water.

2. The modular weir of claim 1, wherein each of the plurality of weirs is thermoformed.

3. The modular weir of claim 1, wherein each of the plurality of weirs comprises one or more body connections configured to connect a first wall and a second wall of the weir at a top of the weir.

4. The modular weir of claim 1, wherein each of the plurality of weirs comprises a weir connection at a first end and a weir connection at a second end of the weir configured to connect the weir to another of the plurality of weirs.

5. The modular weir of claim 1, wherein a length of the plurality of weirs is a same length as a length of a stormwater management crate unit within which the modular weir is positioned.

6. The modular weir of claim 1, wherein each of the plurality of weirs is configured to fit between the plurality of columns in the stormwater management crate.

7. The modular weir of claim 6, wherein each of the plurality of weirs is a blow molded tube, a twin sheet thermoformed tube, or an extruded tube.

8. A modular weir configured to isolate suspended solids from a flow of water in a stormwater management crate, the modular weir comprising:

a plurality of weirs connected together, the plurality of weirs being configured to isolate the flow of water from the stormwater management crate, wherein each of the plurality of weirs comprises:

a tray with a bottom; and a first wall and a second wall, wherein the first wall and the second wall extend at an angle from the bottom of the tray to a top of the plurality of columns in the stormwater management crate;

a plurality of column grooves along the plurality of weirs configured to extend around a plurality of columns in the stormwater management crate;

an inlet located at a first end of the plurality of weirs configured to receive the flow of water within the stormwater management crate; and a cap located at a second end of the plurality of weirs configured to contain the flow of water within the modular weir.

9. The modular weir of claim 8, wherein the first wall and the second wall comprise a plurality of column grooves configured to wrap around the plurality of columns in the stormwater management crate.

10. A modular weir configured to isolate suspended solids from a flow of water in a stormwater management crate, the modular weir comprising:

a plurality of weirs connected together, the plurality of weirs being configured to isolate the flow of water from the stormwater management crate, wherein each of the plurality of weirs comprise:

a first tray having a first wall, a second wall, and a central surface;

a second tray having a first wall, a second wall, and a central surface;

a first connection surface; and a second connection surface, wherein the first wall and the second wall of the first tray extend at an angle from the central surface of the first tray;

the first wall and the second wall of the second tray extend at an angle from the central surface of the second tray;

the first connection surface being located at an end of the first wall of the first tray and the second wall of the second tray; and the second connection surface being located at an end of the second wall of the first tray and the first wall of the second tray;

a plurality of column grooves along the plurality of weirs configured to extend around a plurality of columns in the stormwater management crate;

an inlet located at a first end of the plurality of weirs configured to receive the flow of water within the stormwater management crate; and a cap located at a second end of the plurality of weirs configured to contain the flow of water within the modular weir.

11. The modular weir of claim 10, wherein the first tray and the second tray comprise a plurality of column grooves configured to wrap around the plurality of columns in the stormwater management crate.

12. A modular weir configured to isolate suspended solids from a flow of water in a stormwater management box, the modular weir comprising:

a plurality of weirs configured to isolate the flow of water from the stormwater management box;

a column extension extending at a right angle from each of the plurality of weirs, wherein the column extension is configured to extend between a plurality of columns in the stormwater management box;

an inlet located at a first end of the plurality of weirs configured to receive the flow of water within the stormwater management box; and a cap located at a second end of the plurality of weirs configured to contain the flow of water within the modular weir;

wherein each of the plurality of weirs comprises a flat bottom configured to collect the suspended solids from the flow of water.

13. The modular weir of claim 12, wherein each of the plurality of weirs is thermoformed.

14. The modular weir of claim 12, wherein each of the plurality of weirs further comprises one or more body connections configured to connect a first wall and a second wall of each of the plurality of weirs at a top of each of the plurality of weirs.

15. The modular weir of claim 12, wherein each of the plurality of weirs further comprises a weir connection at a first end and a weir connection at a second end of the weir configured to connect to another weir of the plurality of weirs.

16. A flat sheet weir configured to isolate suspended solids from a flow of water in a stormwater management box, the flat sheet weir comprising:

an inlet configured to receive the flow of water within the stormwater management box;

a top column panel and a bottom column panel configured to cover a top plate and a base plate of the stormwater management box; and a first side panel and a second side panel configured to extend between the top column panel and the bottom column panel outside a plurality of columns in the stormwater management box.

17. The flat sheet weir of claim 16, wherein the top column panel and the bottom column panel further comprise a plurality of openings configured to fit around the plurality of columns in the stormwater management box.

18. The flat sheet weir of claim 16, wherein the first side panel and the second side panel extend between the top plate and the bottom plate within the plurality of columns in the stormwater management box.

* * * * *